US007434279B2

(12) United States Patent
Chen et al.

(10) Patent No.: US 7,434,279 B2
(45) Date of Patent: Oct. 14, 2008

(54) FOLDING DEVICE FOR PLAYPEN

(75) Inventors: Shun-Min Chen, Taipei (TW); Jian-Qun Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 64 days.

(21) Appl. No.: 11/546,921

(22) Filed: Oct. 13, 2006

(65) Prior Publication Data

US 2007/0277308 A1 Dec. 6, 2007

(30) Foreign Application Priority Data

Jun. 2, 2006 (CN) ..... 2006 2 0115738 U

(51) Int. Cl.
*A47D 13/06* (2006.01)

(52) U.S. Cl. ..... 5/98.1; 5/99.1

(58) Field of Classification Search ..... 5/98.1, 5/99.1; 403/103, 104
See application file for complete search history.

(56) References Cited

U.S. PATENT DOCUMENTS 4,688,280 A * 8/1987 Kohus et al. ..... 5/99.1
5,526,542 A * 6/1996 Huang ..... 5/99.1
5,761,754 A 6/1998 Cheng
6,349,434 B1 2/2002 Zhuang
6,721,970 B1 * 4/2004 Cheng ..... 5/99.1
7,043,780 B1 * 5/2006 Cheng ..... 5/99.1
7,293,304 B2 * 11/2007 Chen et al. ..... 5/99.1

* cited by examiner

*Primary Examiner*—Michael Trettel
(74) *Attorney, Agent, or Firm*—Birch, Stewart, Kolasch & Birch, LLP

(57) ABSTRACT

A folding device for each of four support legs of a playpen includes a bottom rod and a post pivotably and respectively connected to a first position and a second position of each support leg. A locking device is connected to the bottom rods and a connection member is connected to a top of each post. Four top rods are pivotably connected to the four connection members. A movable member is movably connected to the post which is pivotably connected to the support leg so that the post is secured to the support leg or the support leg can be pivotable relative to the post by operation of the movable member. The bottom rods and the top rods can be pivoted toward each and the support legs can be further pivoted relative to the post so as to reduce the storage size of the frame of the playpen in folded state.

18 Claims, 11 Drawing Sheets

FOLDING DEVICE FOR PLAYPEN

BACKGROUND OF THE INVENTION

1. Field of the Invention

The present invention relates to a folding device for a playpen, and in particular to a folding device which allows the legs of the playpen to be further folded so as to occupy less space.

2. The Prior Arts

A conventional collapsing mechanism is used on a playpen such that the frame of the playpen can be folded when not in use and the frame occupies less space which is convenient for storage and carried. U.S. Pat. No. 6,349,434 discloses a playpen which includes four coupling bases on four top rods and a support base which is connected bottom rods of the playpen. The playpen can be folded by pulling the coupling bases and the support base such that the top rods and the bottom rods are pivoted to reduce the space of the frame of the playpen. However, it is noted that the height of the frame is still too long so that a larger space is needed when the manufacturers pack the frames and this means a high cost is involved. Besides, the length of the frame of the conventional playpen is too long to be put in rear trunk of cars.

U.S. Pat. No. 5,761,754 discloses a foldable playpen wherein the support legs can be folded by a link device to make the frame of the playpen to be easily stored and transported. Since the link device is complicated, the packaging cost is higher and the breakdown is increased.

Therefore, a new folding device for the playpens is needed and the folding device is required to further reduce the size required when the frame is folded such that the manufacturers and the users can easily and conveniently fold the frame and store the frame in a small space.

SUMMARY OF THE INVENTION

A primary objective of the present invention is to provide a folding device for a playpen in where the support legs can be further pivoted to reduce the storage size of the frame of the playpen.

The present invention is to provide a folding device for a playpen, wherein the folding device is cooperated with each of the support legs of the playpen and a bottom rod and a post are pivotably and respectively connected to a first position and a second position of the support leg. A movable member is movably connected to the post so that the post is secured to the support leg when in use state or the support leg can be pivoted relative to the post by the movable member when in folded state.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
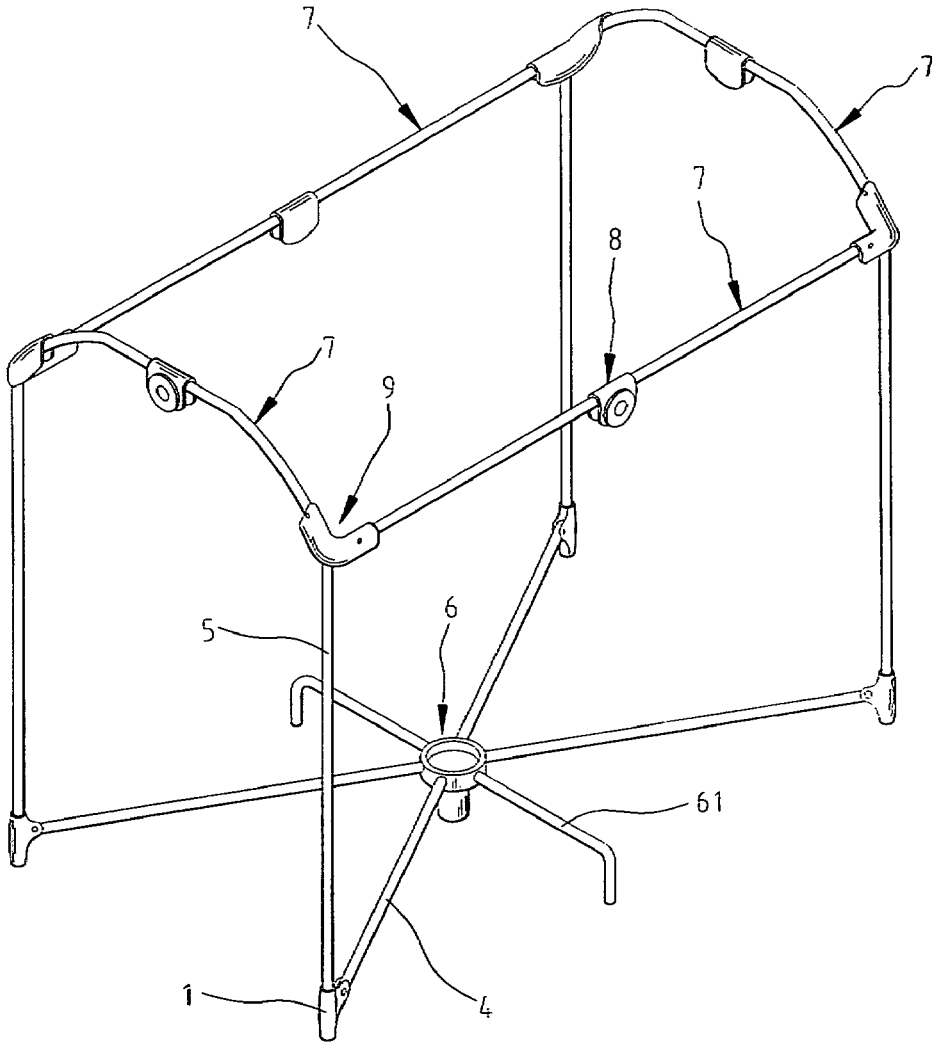
FIG. 1 is a perspective view showing a frame of a playpen in a use state in accordance with the present invention.
Figure 2:
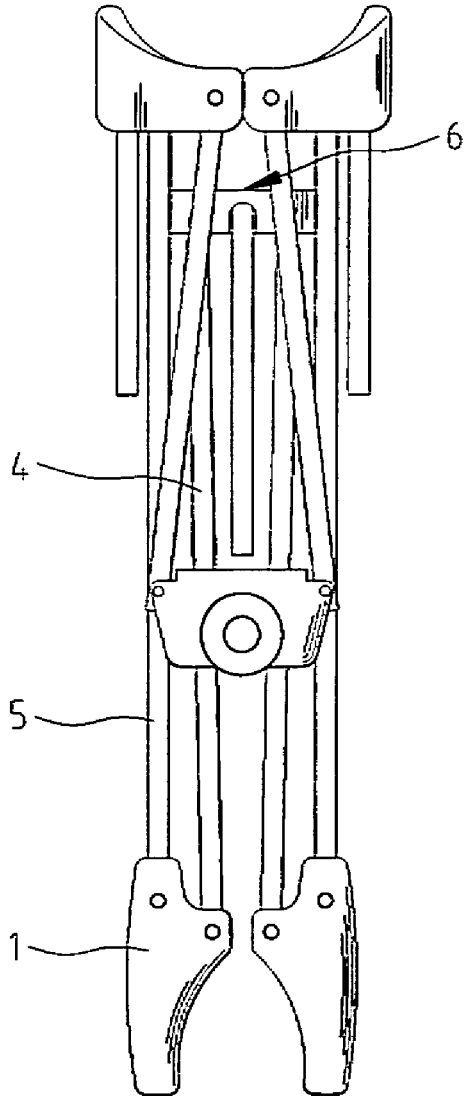
FIG. 2 shows the frame of the playpen in a folded state.
Figure 3:
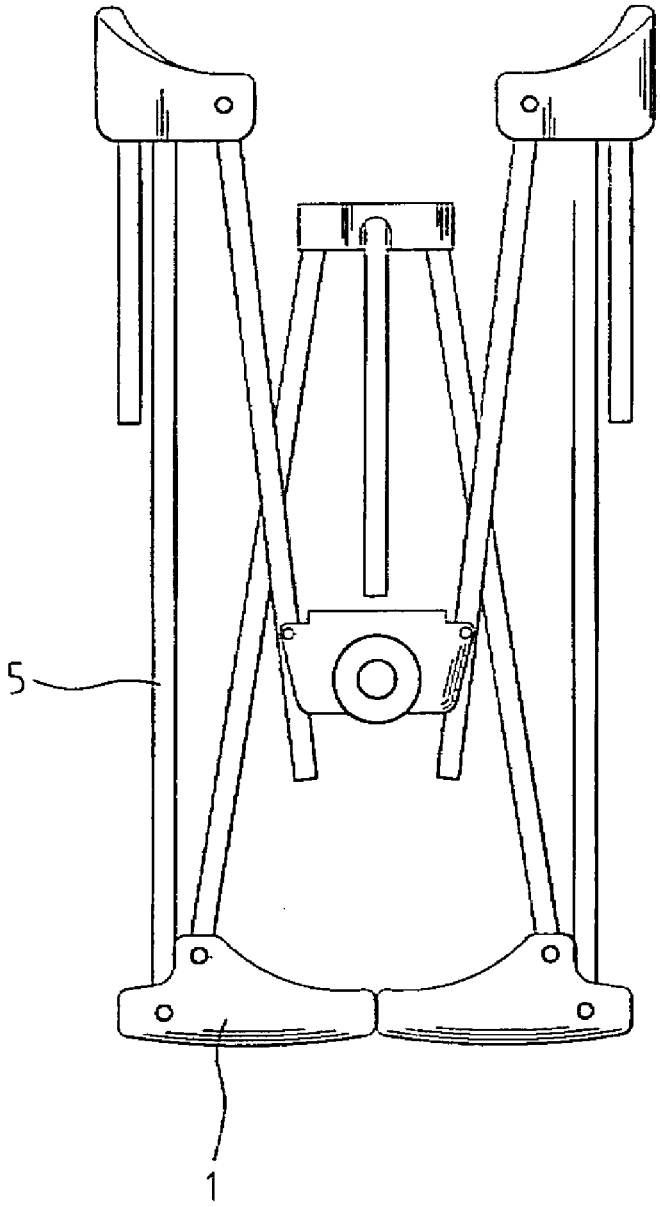
FIG. 3 shows that the support legs can be further folded when the frame of the playpen is in the folded state.

With reference to the drawings and in particular to FIGS. 1 and 2, the frame of a playpen in accordance with the present invention includes four top rods 7 on four sides thereof and each top rod 7 has a latch device 8 which allows the top rod 7 to be folded. The four corners formed by the four top rods 7 each have a 3-way connection member 9 and each connection member 9 is connected to an upper end of a post 5. Four support legs 1 each have a first position and a second position, wherein a first end of a bottom rod 4 is connected to the first position of each of the support legs 1 and each post 5 is connected with the second position of the support leg 1 at a lower end thereof. A second end opposite to the first end of the bottom rod 4 is pivotably connected with a locking device 6 which has two L-shaped extension legs 61. The top rods 7, the connection members 9, the posts 5, the support legs 1, the extension legs 61 and the bottom rods 4 form the frame of the playpen, and the latch devices 8 and the locking device 6 maintain the top rods 7 and the bottom rods 4 in substantially horizontal position respectively when the frame is in a use state. When folding the playpen, the top rods 7 are folded at the latch devices 8 and the bottom rods 4 are pivoted relative to the support legs 1, and the locking device 6 is lifted upward to pivot the extension legs 61 and the bottom rods 4 at the second ends of the bottom rods 4 as shown in FIG. 2. The support legs 1 can further be pivoted inward so as to reduce the total size when the frame is in folded state.

Figure 4:
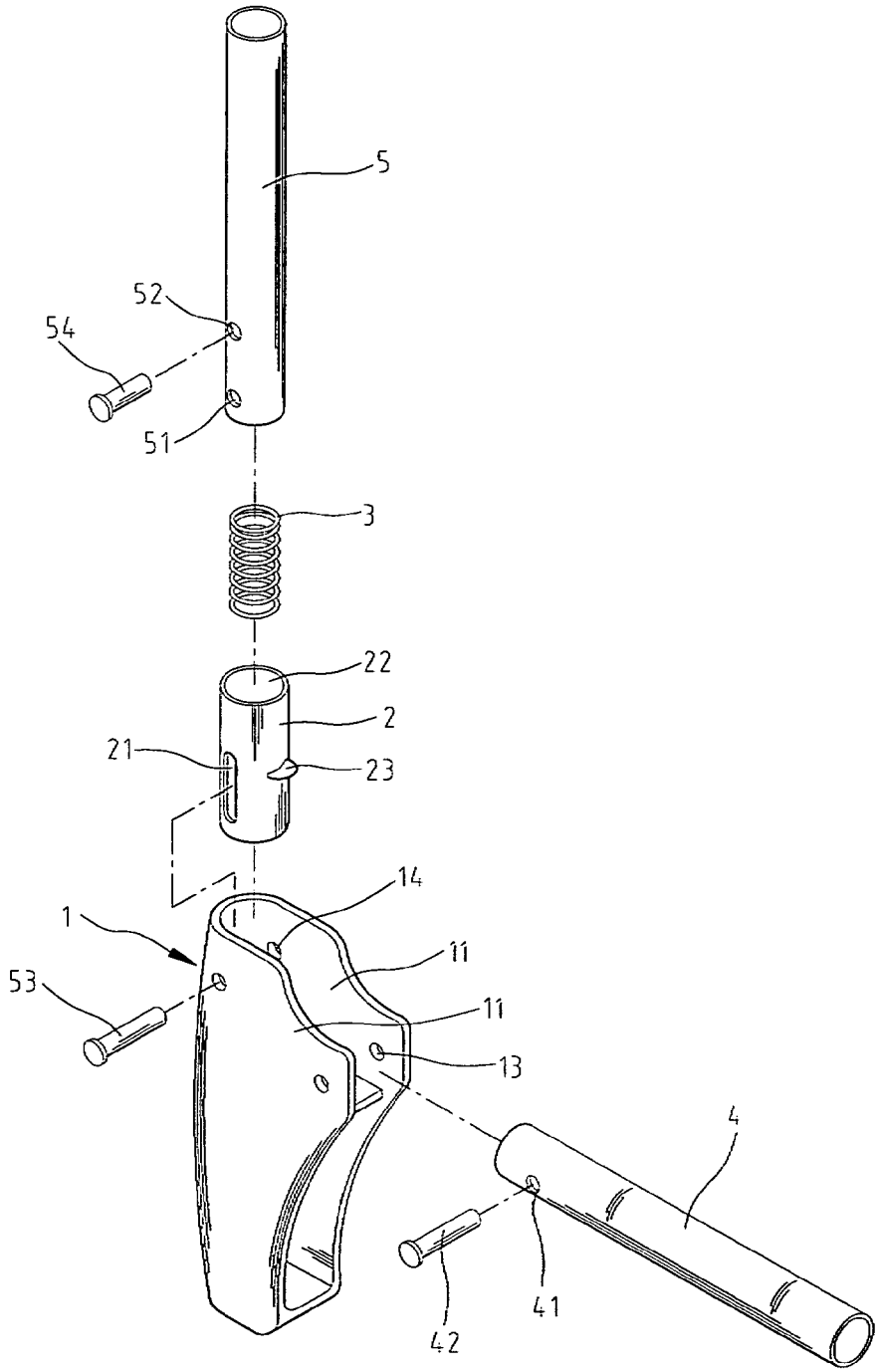
FIG. 4 is an exploded view of a first preferred embodiment of the folding device of the playpen of the present invention.
Figure 5:
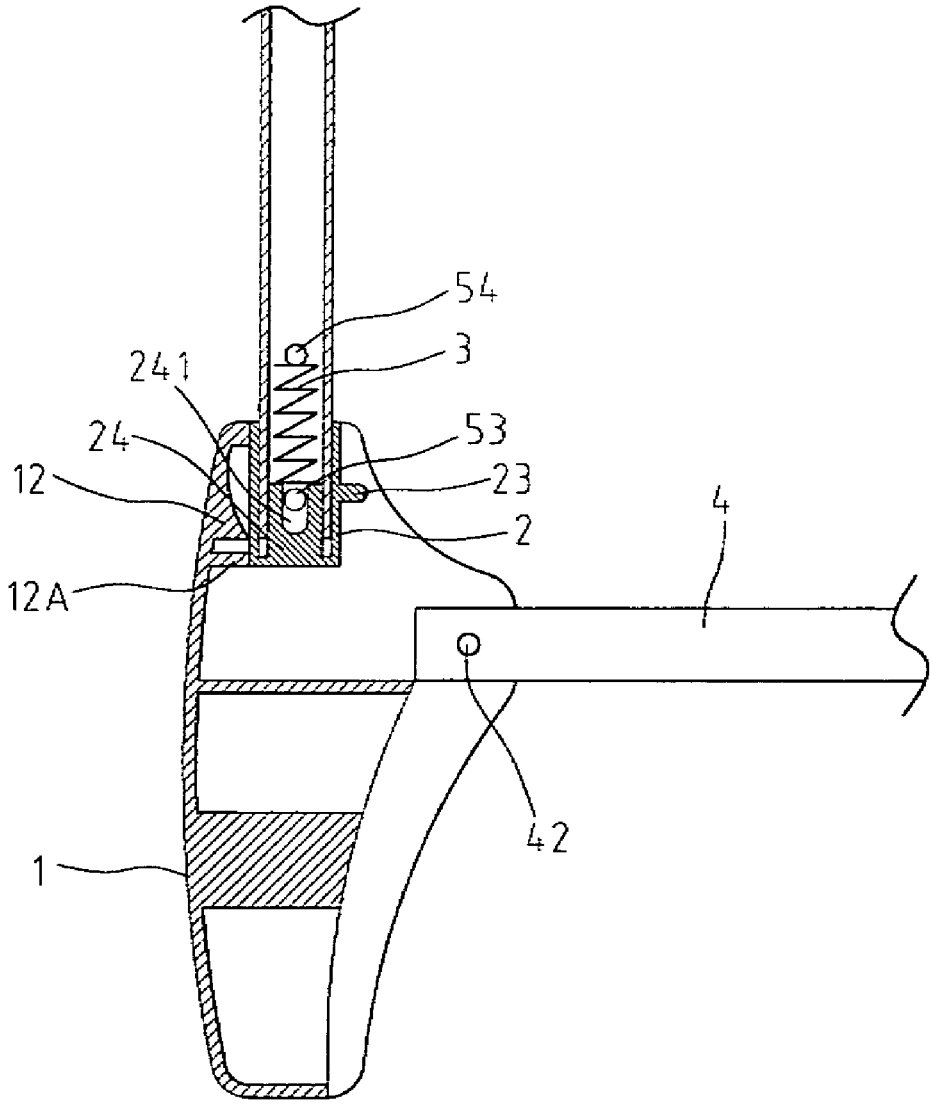
FIG. 5 is a cross sectional view to show the folding device when the frame is in the use state.

Referring to FIGS. 4 and 5, a movable member such as a sleeve 2 is movably connected to the post 5 and has a recess 22 defined in a top thereof. A lower end of the post 5 is inserted into the recess 22. The bottom of the recess 22 is formed with a U-shaped member 24 and a groove 241 is defined on the top of the U-shaped member 24. A spring member 3 that is a compressing spring is located between the U-shaped member 24 of the sleeve 2 and the post 5. The spring member 3 has one end rested on a top of the U-shaped member 24 and the other end of the spring member 3 is in contact with a pin 54 extending through a hole 52 in the post 5. Each support leg 1 has a vertical wall including two parallel sidewalls 11 between which an open side and an open top are defined, wherein the open side faces the locking device 6. A pin 53 extends through two second holes 14 on the respective two sidewalls 11 at the second position of the support leg 1, a slot 21 formed axially through two opposing side walls of the sleeve 2, and the groove 241 of the U-shaped member 24. The support leg 1 has two first holes 13 at its first position and a pin 42 extends through the two first holes 13 and the hole 41 in the bottom rod 4 to pivotably connect with the bottom rod 4. The support leg 1 includes a stop extending from the vertical wall thereof and the stop is abutted against the outer surface of the sleeve 2. The stop is two ribs 12, 12A in this embodiment and one rib 12 is located at a higher position and the other rib 12A is located at a lower position. The spring member 3 urges the sleeve 2 to the support leg 1 such that the support leg 1 is unable to pivot relative to the post 5 as shown in FIG. 5 when the frame is in a use state.

Figure 6:
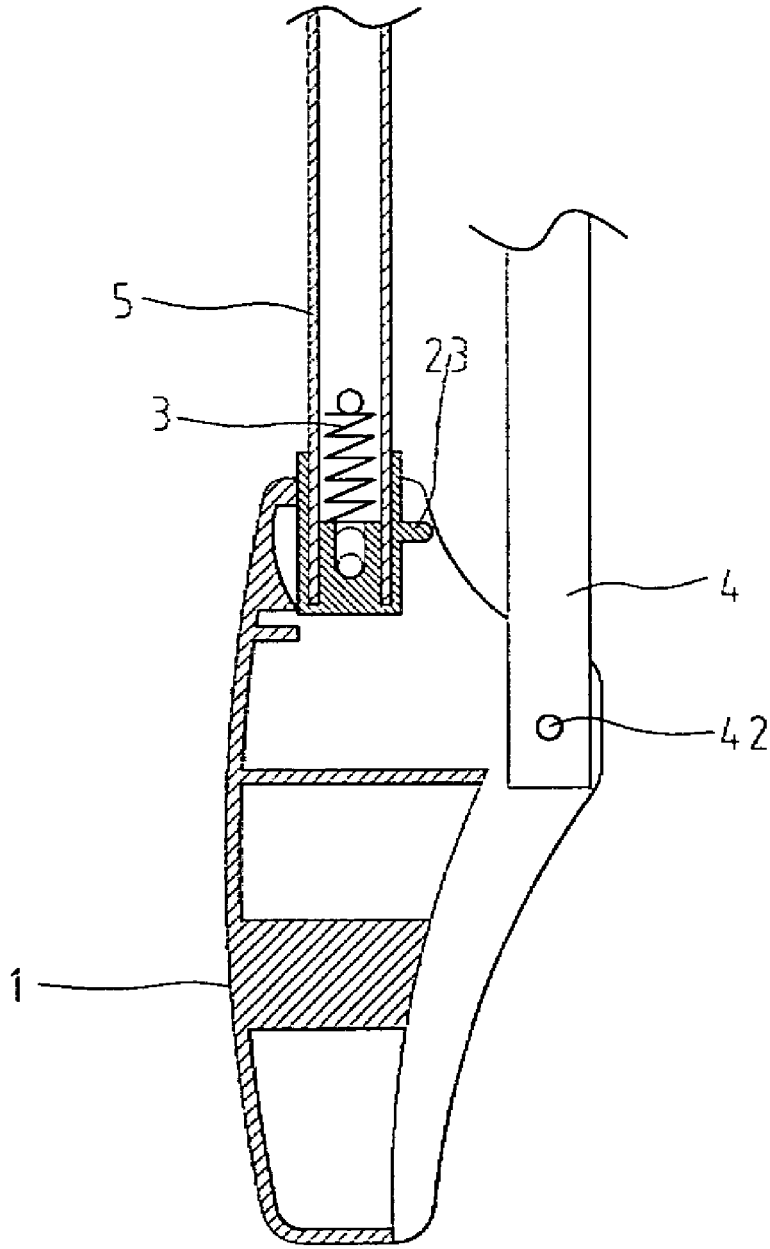
FIG. 6 shows that a bottom rod is pivoted upward when folding the playpen.

The sleeve 2 has a lever 23 extending from an outer surface thereof so that the user may move the sleeve 2 upward by pressing the lever 23. As shown in FIG. 6, when the frame of the playpen is moving from the use state to the folded state, the latch devices 8 are operated to pivot the top rods 7, the locking device 6 is unlocked and lifted, the bottom rods 4 are pivoted about the pins 42 so that the frame is folded to a compact status. The user then lifts the sleeve 2 which is moved away from the two ribs 12, 12A and the support leg 1 can be pivoted relative to the post 5 about the pin 53 so as to further reduce a combination length of each post 5 and the corresponding support leg 1 when the frame of the playpen is in the folded state, which results in a smaller storage space (see FIG. 7).

Figure 8:
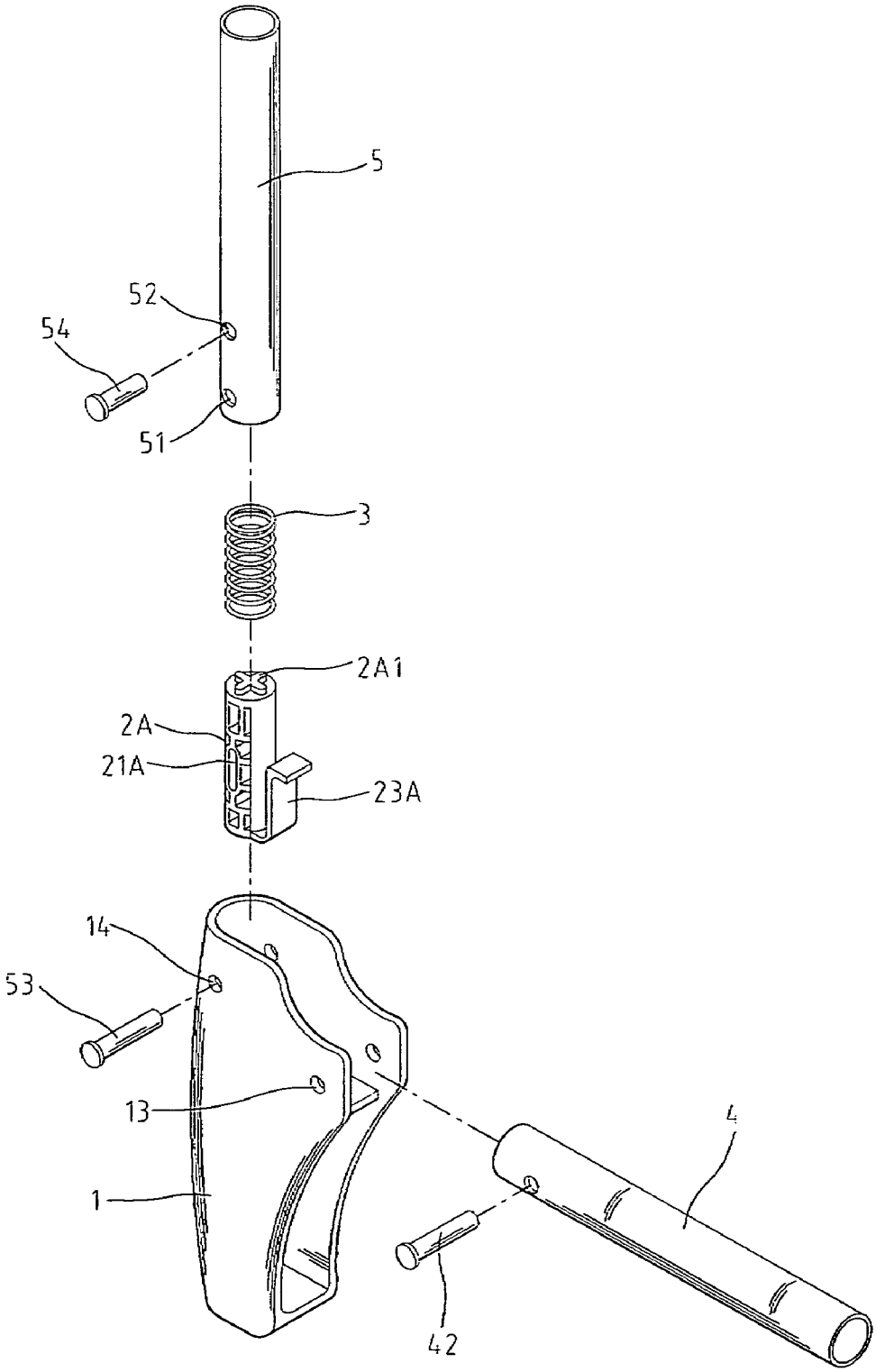
FIG. 8 is an exploded view of a second preferred embodiment of the folding device of the playpen of the present invention.
Figure 9:
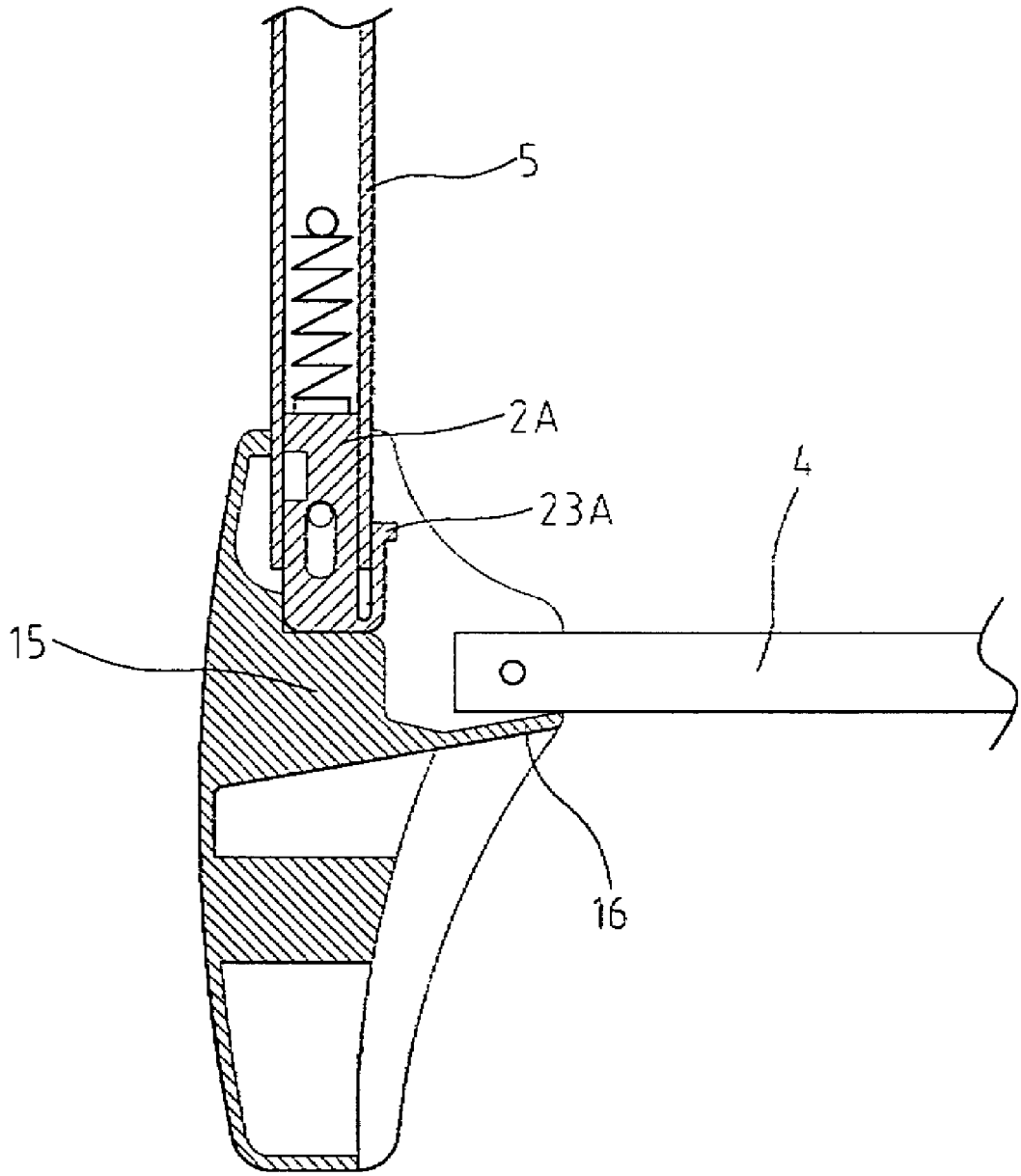
FIG. 9 is a cross sectional view to show the folding device in FIG. 8 when the frame is in the use state.

FIGS. 8 and 9 show a second embodiment of the present invention wherein the stop is formed a protruding flange 15 on the vertical wall of the support leg 1. The support leg 1 further has a lengthy rib 16 extending from the vertical wall and is under the protruding flange 5. The rib 16 of the support leg 1 is abutted against the bottom rod 4 to prevent the support leg 1 from being pivoted when the movable member is untentionally lifted. The movable member in this embodiment is a cylindrical member 2A which can be a solid or hollow cylindrical member and an outer diameter of the cylindrical member 2A is smaller than an inner diameter of the lower end of the post 5. A top of the cylindrical member 2A is inserted into the lower end of the post 5 and includes a block 2A1. The spring member 3 is received in the lower end of the post 5 and mounted on the block 2A1 of the cylindrical member 2A. The pin 53 extends through the slot 21A of the cylindrical member 2A. The cylindrical member 2A has a lever 23A which extends from a lower end of the cylindrical member 2A and toward longitudinally for a length.

Figure 7:
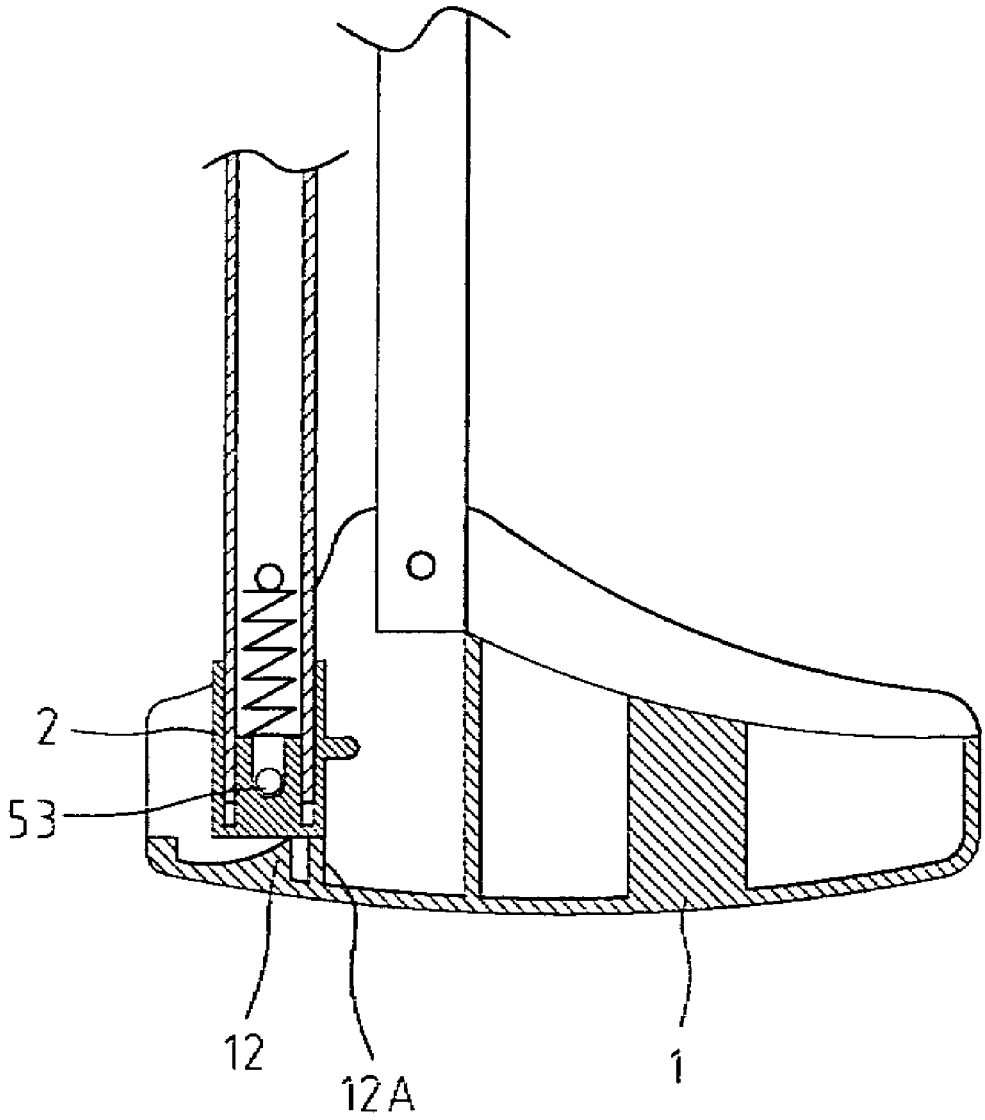
FIG. 7 shows that the support leg is pivoted to reduce the required size of the playpen when in folded state.
Figure 10:
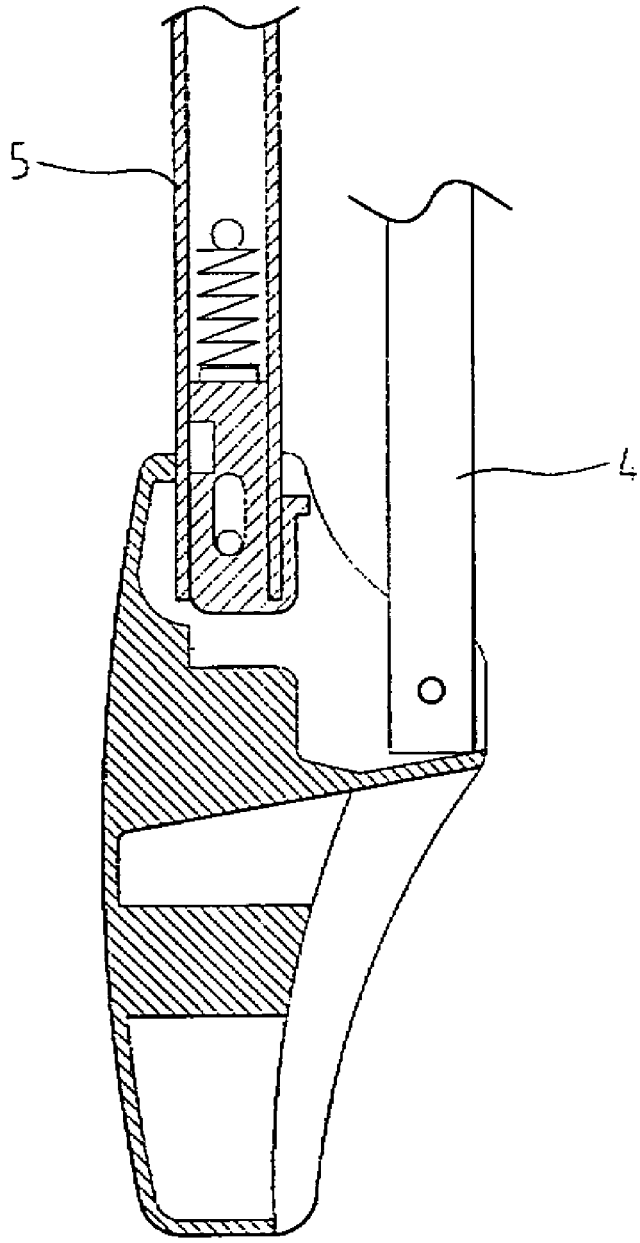
FIG. 10 shows that a bottom rod in FIG. 8 is pivoted upward when folding the playpen.
Figure 11:
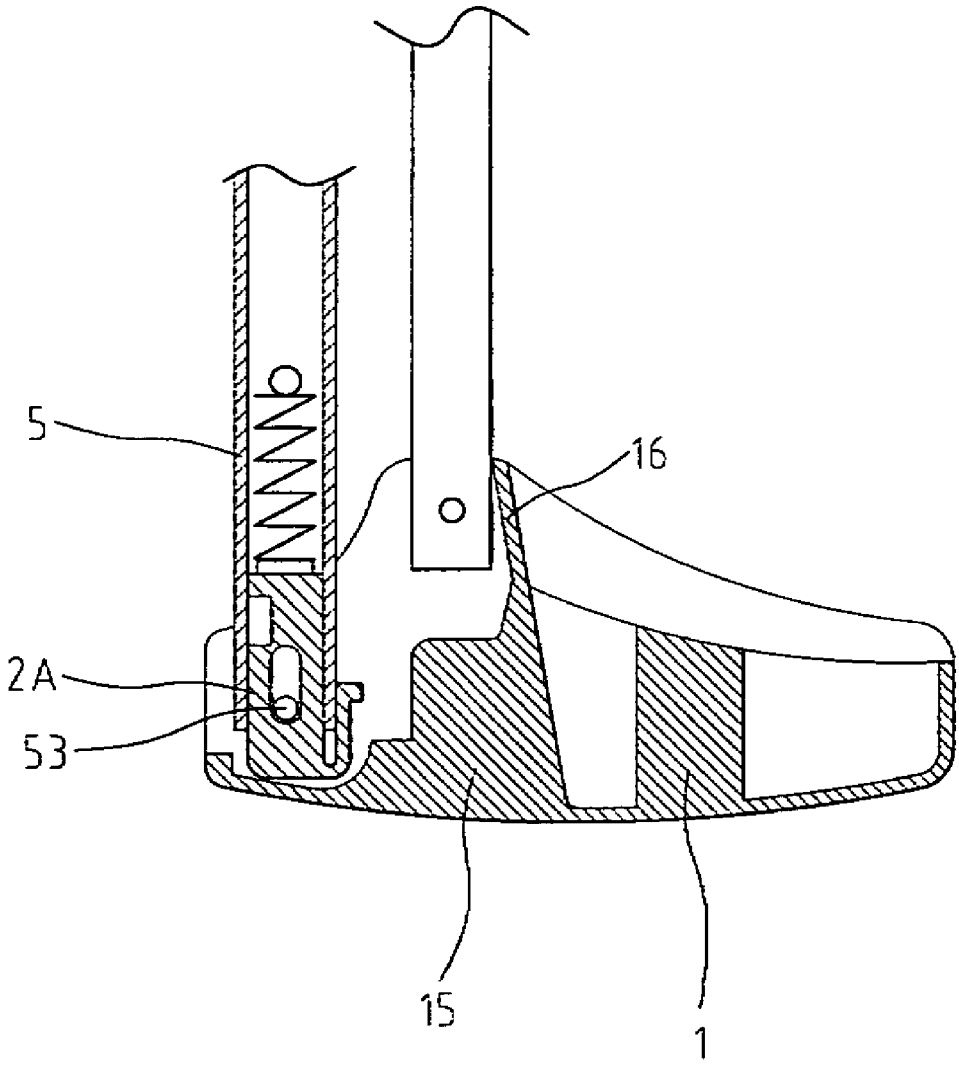
FIG. 11 shows that support leg in FIG. 8 is pivoted to reduce the required size of the playpen when in folded state.

Referring to FIGS. 10 and 11, the actions for folding the playpen are the same as described in the first embodiment in FIGS. 6 and 7. The latch devices 8 are operated to pivot the top rods 7 and the locking device 6 is unlocked and lifted. The bottom rods 4 are pivoted about the pins 42 so that the frame is folded to a compact status. The user then lifts the cylindrical member 2A and the support leg 1 is then pivoted about the pin 53 as shown in FIG. 11 to further reduce the size of the frame.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A folding device for a playpen, comprising:

a support leg;

a bottom rod and a post pivotably and respectively connected to a first position and a second position of the support leg;

a movable member movably connected to the post so that the support leg is selectively secured to the post or pivoted relative to the post wherein the movable member is located at a lower end of the post and movable linearly relative to the post; and a spring member mounted between the movable member and the post; said spring member urging the movable member toward the support leg.

2. The device as claimed in claim 1, wherein the support leg includes a vertical wall and a stop on the wall to abut against an outer surface of the movable member.

3. The device as claimed in claim 2, wherein the movable member includes a slot defined axially through two opposing sides of a wall thereof and a pin extends through the slot and pivotably connects the support leg to the post.

4. The device as claimed in claim 3, wherein the movable member is a sleeve which has a recess defined in a top thereof and the lower end of the post is inserted into the recess, the spring member is received in the recess and the lower end of the post.

5. The device as claimed in claim 4, wherein the sleeve has a U-shaped member formed on a bottom of the recess and a groove is defined on a top of the U-shaped member, the spring member has one end rested on the top of the U-shaped member, the pin extends through the slot of the sleeve and the groove.

6. The device as claimed in claim 2, wherein the movable member has a lever extending from the outer surface of the moveable member.

7. The device as claimed in claim 4, wherein the stop is two ribs extending from the wall of the support leg and one rib is located at a higher position and the other rib is located at a lower position.

8. The device as claimed in claim 1, wherein the spring member is a compression spring.

9. The device as claimed in claim 3, wherein the movable member is a cylindrical member and an outer diameter of the cylindrical member is smaller than an inner diameter of the lower end of the post, a top of the cylindrical member is inserted into the lower end of the post, the spring member is received in the lower end of the post and abuts against the top of the cylindrical member.

10. The device as claimed in claim 9, wherein the cylindrical member has a lever.

11. The device as claimed in claim 10, wherein the lever extends from a lower end of the cylindrical member and toward longitudinally for a length.

12. The device as claimed in claim 9, wherein the stop is a protruding flange extending from the wall of the support leg.

13. The device as claimed in claim 2, wherein a rib extends from the wall of the support leg and abuts against the bottom rod.

14. The device as claimed in claim 9, wherein the spring member is a compression spring.

15. A playpen movable between a use state and a folded state, comprising:

a plurality of top rods forming a top frame;

a plurality of bottom rods forming a bottom frame;

a plurality of posts each having an upper end connected to the top frame and a lower end opposite to the upper end of the post;

a plurality of support legs each having a first position pivotably connected to the bottom rod of the bottom frame and a second position pivotably connected to the lower end of the post;

a movable member located near the lower end of each post; and wherein when the playpen is in a use state, the support leg is fixedly connected to the post and when the playpen is in a folded state, the movable member is moved relative to the post so that the support leg is capable of being pivoted relative to the post.

16. The playpen as claimed in claim 15, wherein the movable member is mounted on the lower end of the post and is movable linearly relative to the post.

17. The playpen as claimed in claim 15, wherein the support leg includes a stop abutting against the movable member when the playpen is in the use state.

18. A playpen, comprising:

a post;

a bottom rod;

a support leg having a vertical wall and a stop extending from the wall, the wall including two parallel sidewalls between which an open top where the post is pivotably connected to and an open side where the bottom rod is pivotably connected to, are defined; and a movable member movably connected to the post so that the support leg is selectively secured to the post when the stop of the support leg is abutted against the movable member or is pivoted relative to the post when the movable member is moved relative to the post.

* * * * *